US011316297B2

(12) United States Patent
Chang et al.

(10) Patent No.: US 11,316,297 B2
(45) Date of Patent: Apr. 26, 2022

(54) ELECTRICAL PLUG CONNECTOR

(71) Applicant: ADVANCED-CONNECTEK INC., New Taipei (TW)

(72) Inventors: Ming-Yung Chang, New Taipei (TW); Chia-Cheng He, New Taipei (TW); Jian-Bo Luo, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 17/025,520

(22) Filed: Sep. 18, 2020

(65) Prior Publication Data

US 2021/0091520 A1 Mar. 25, 2021

Related U.S. Application Data

(60) Provisional application No. 62/902,687, filed on Sep. 19, 2019.

(51) Int. Cl.

| | |
|---|---|
| ***H01R 13/424*** | (2006.01) |
| ***H01R 24/60*** | (2011.01) |
| ***H01R 13/506*** | (2006.01) |
| ***H01R 13/405*** | (2006.01) |
| ***H01R 13/26*** | (2006.01) |
| ***H01R 13/42*** | (2006.01) |
| ***H01R 13/627*** | (2006.01) |
| ***H01R 13/629*** | (2006.01) |
| ***H01R 13/6583*** | (2011.01) |
| ***H01R 13/11*** | (2006.01) |
| ***H01R 107/00*** | (2006.01) |

(52) U.S. Cl.

CPC ..... *H01R 13/424* (2013.01); *H01R 13/11* (2013.01); *H01R 13/26* (2013.01); *H01R 13/405* (2013.01); *H01R 13/42* (2013.01); *H01R 13/506* (2013.01); *H01R 13/629* (2013.01); *H01R 13/6271* (2013.01); *H01R 13/6583* (2013.01); *H01R 24/60* (2013.01); *H01R 2107/00* (2013.01)

(58) Field of Classification Search

CPC ..... H01R 13/6271; H01R 13/6273; H01R 13/629; H01R 13/6583; H01R 24/60; H01R 2107/00

See application file for complete search history.

(56) References Cited

U.S. PATENT DOCUMENTS

| | | | | |
|---|---|---|---|---|
| 9,450,337 | B2 * | 9/2016 | Kao | H01R 13/6461 |
| 9,478,923 | B2 * | 10/2016 | Kao | H01R 24/60 |
| 9,502,837 | B2 * | 11/2016 | Kao | H01R 13/6597 |
| 11,075,490 | B2 * | 7/2021 | Tsai | H01R 12/724 |
| 2016/0064864 | A1 * | 3/2016 | Kao | H01R 13/6461 439/607.05 |

(Continued)

*Primary Examiner* — Oscar C Jimenez

(74) *Attorney, Agent, or Firm* — Muncy, Geissler, Olds & Lowe, P.C.

(57) ABSTRACT

An electrical plug connector includes a metallic shell, an insulated housing in the metallic shell, plug terminals held in the insulated housing, and a hook member. Hook portions of the hook member extend into the insertion cavity of the insulated housing. Each hook portion forms a first positioning portion and a second positioning portion. When the electrical plug connector is mated with an electrical receptacle connector, the electrical plug connector can be positioned with the electrical receptacle connector through multiple contacts, thereby preventing the electrical plug connector from shaking.

16 Claims, 11 Drawing Sheets

(56) References Cited

U.S. PATENT DOCUMENTS

| | | | | |
|---|---|---|---|---|
| 2017/0070009 | A1* | 3/2017 | Chen | H01R 43/24 |
| 2017/0149172 | A1* | 5/2017 | Nishikata | H01R 13/41 |
| 2017/0358895 | A1* | 12/2017 | Chung | H01R 24/60 |
| 2018/0294604 | A1* | 10/2018 | Chien | H01R 13/41 |
| 2019/0036276 | A1* | 1/2019 | Chu | H01R 13/6594 |

* cited by examiner

ELECTRICAL PLUG CONNECTOR

CROSS-REFERENCE TO RELATED APPLICATION

This non-provisional application claims priority under 35 U.S.C. § 119(e) to U.S. Provisional Patent Application No. 62/902,687, filed on Sep. 19, 2019, the entire contents of which are hereby incorporated by reference.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a USB type-C electrical connector known to the inventor(s) are totally different from those of a USB electrical connector known to the inventor(s). A USB type-C electrical receptacle connector known to the inventor (s) includes a plastic core, plug terminals held on the plastic core, an outer iron shell circularly enclosing the plastic core, hook structures at two sides of the plastic core.

SUMMARY OF THE INVENTION

Please refer to FIG. 1. FIG. 1 illustrates a top sectional view showing that a USB type-C electrical receptacle connector and a USB type-C electrical plug connector known to the inventor(s) are assembled with each other. The tongue portion A1 of the USB type-C electrical receptacle connector has a shielding plate A, and two sides of the shielding plate A4 comprises protrusions A5 protruded out of two sides of the tongue portion A1. The hook member B of the USB type-C electrical plug connector has two side arms B3 and two buckling portions B5 at front ends of the two side arms B3. Inner sides of the side arms B3 have inner side surfaces B31 in curved shape, and the buckling portions B5 are buckled with the protrusions A5, respectively. The side portion of each of the protrusions A5 has a first side surface A51, a second side surface A52, and a third side surface A53. The first side surface A51, the third side surface A53, and the second side surface A52 are arranged in order, from an end portion of the protrusion A5 away from the tongue portion A1 toward an end portion of the protrusion A5 coming toward the tongue portion A1.

When the electrical plug connector is mated with the electrical receptacle connector, the contact portion B51 of the buckling portion B5 is buckled with the first side surface A51 of the protrusion A5 (as the bottom portion of the protrusion A5 shown in FIG. 1), a gap C is then formed between the second side surface A52 (as the side portion of the protrusion A5 shown in FIG. 1), the third side surface A53 (as the top portion of the protrusion A5 shown in FIG. 1), and the inner side surface B31 of the side arm B3. As a result, the electrical plug connector is easy to get loosen in the Z axis direction, and the degree of freedom for the downward movement of the hook member B is not limited.

In view of these, according to one or some embodiments of the instant disclosure, an electrical plug connector is provided. The electrical plug connector is suitable for being mated with an electrical receptacle connector. Two protrusions are at two sides of a tongue portion of the electrical receptacle connector, and each of the protrusions has a first side surface, a second side surface, and a third side surface. The second side surfaces are at two sides of an end portion of the tongue portion. The two third side surfaces outwardly extend from side portions of the two second side surfaces, respectively. The two first side surfaces extend toward a middle portion of the tongue portion from side portions of the two third side surfaces, respectively. The electrical plug connector comprises a metallic shell, an insulated housing, a plurality of plug terminals, and a hook member. The metallic shell comprises a receiving cavity. The insulated housing is received in the metallic shell. One of two ends of the insulated housing comprises an insertion cavity. The plug terminals are held in the insulated housing, and one end of each of the plug terminals extends into the insertion cavity. The hook member comprises a plurality of side arms and a plurality of hook portions. The side arms are respectively at two sides of the insulated housing. Each of the hook portions is at an end portion of the corresponding side arm and extends into the insertion cavity. An inner side of each of the hook portions forms a first positioning portion and a second positioning portion. The first positioning portion is adjacent to an end portion of the hook portion and is at an outer side of the hook member, and the second positioning portion is away from the end portion of the hook portion and is at an inner side of the hook member. Each of the first positioning portions is provided for being in contact with the first side surface of the corresponding protrusion, and each of the second positioning portions is provided for being in contact with the second side surface of the corresponding protrusion.

In one or some embodiments, each of the hook portions comprises a third positioning portion between the first positioning portion and the second positioning portion. The first positioning portion, the second positioning portion, and the third positioning portion are formed as a geometrical recessed structure, and the third positioning portion is provided for being in contact with the third side surface.

In one or some embodiments, an angle is between the second positioning portion and the third positioning portion, and the angle is in a range between 110 degrees and 160 degrees.

In one or some embodiments, the other end of the insulated housing comprises an assembling groove communicating with the insertion cavity, and the two sides of the insulated housing comprise two recessed portions respectively communicating with the insertion cavity.

In one or some embodiments, the plug terminals comprise a plurality of first plug terminals and a plurality of second plug terminals. The electrical plug connector further comprises a first assembling block and a second assembling block. The first assembling block is molded with the first plug terminals, and the second assembling block is molded with the second plug terminals.

In one or some embodiments, the first plug terminals comprise a plurality of first signal terminals, at least one first power terminal, and at least one first ground terminal; the second plug terminals comprise a plurality of second signal terminals, at least one second power terminal, and at least one second ground terminal.

In one or some embodiments, an inner side of each of the side arms comprises a straight surface extending linearly.

In one or some embodiments, an outer side of each of the side arms comprises an inclined surface extending obliquely.

In one or some embodiments, the electrical plug connector further comprises a plurality of abutting sheets respectively at an upper surface and a lower surface of the insulated housing.

In one or some embodiments, the electrical plug connector further comprises a plurality of stopping sheets, and each of the stopping sheets is between the corresponding abutting sheet and the metallic shell.

According to one or some embodiments of the instant disclosure, the hook portion of the hook member forms the first positioning portion and the second positioning portion. The first positioning portions are provided for buckling with the first side surfaces of the protrusions on the two sides of the tongue portion of the electrical receptacle connector, and the second positioning portions are provided for buckling with the second surface side surfaces of the protrusions on the two sides of the tongue portion of the electrical receptacle connector. Accordingly, the electrical plug connector can be positioned with the electrical receptacle connector through multiple contacts, thereby preventing the electrical plug connector from shaking when the electrical plug connector is mated with the electrical receptacle connector.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
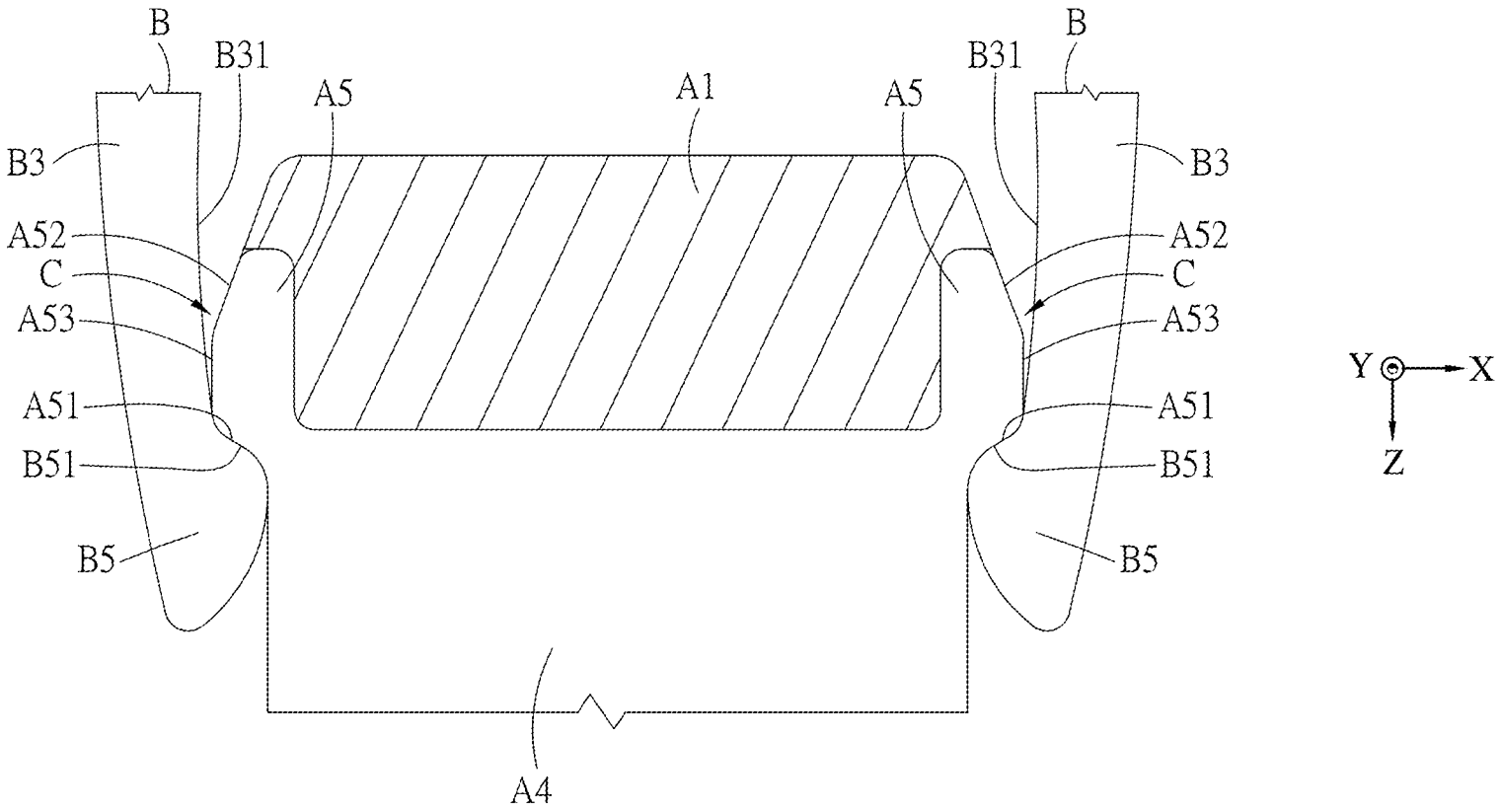
FIG. 1 (PRIOR ART)
FIG. 1 illustrates a top sectional view showing that a USB type-C electrical receptacle connector and a USB type-C electrical plug connector known to the inventor(s) are assembled with each other.
Figure 2:
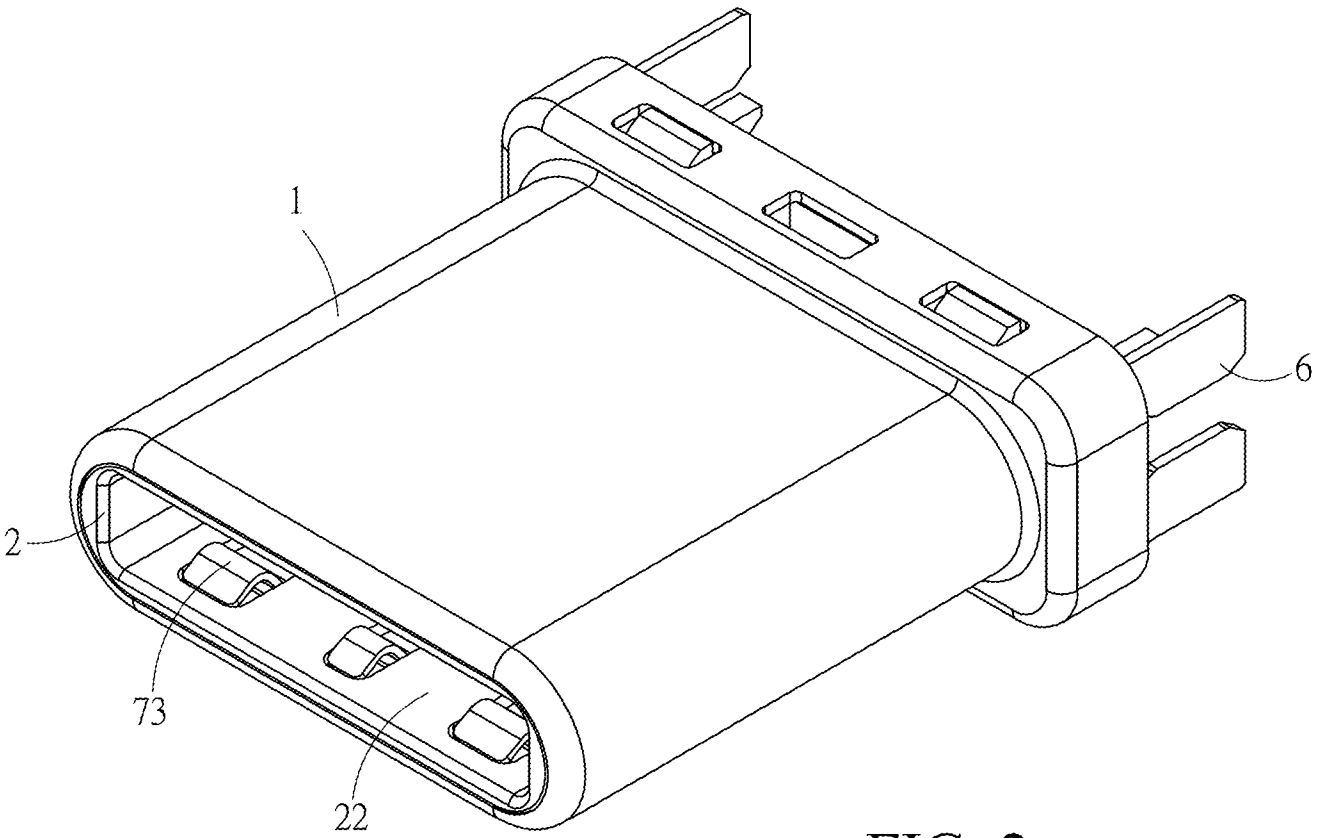
FIG. 2 illustrates a perspective view of an electrical plug connector according to an exemplary embodiment of the instant disclosure.
Figure 3:
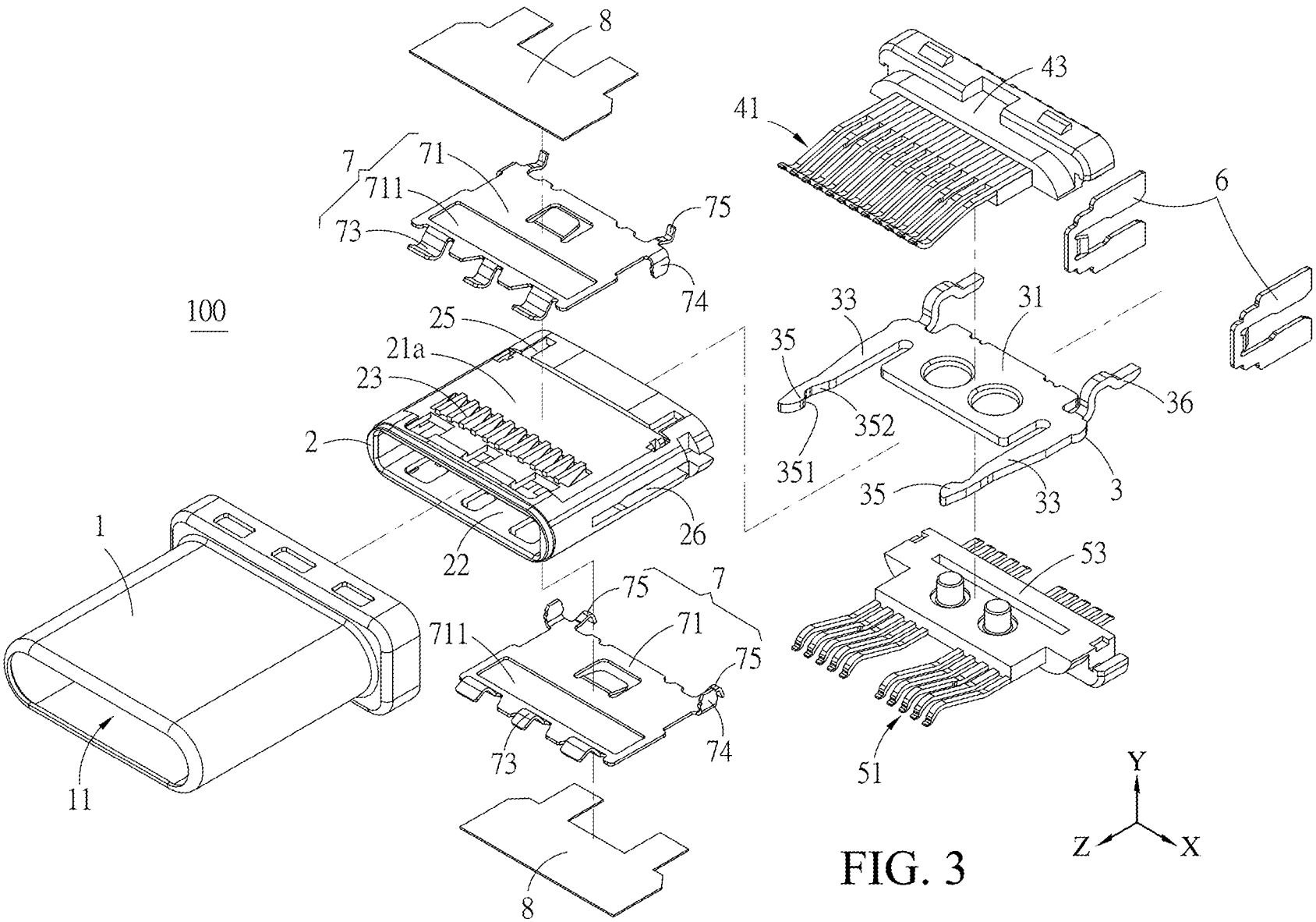
FIG. 3 illustrates an exploded view (1) of the electrical plug connector of the exemplary embodiment.
Figure 4:
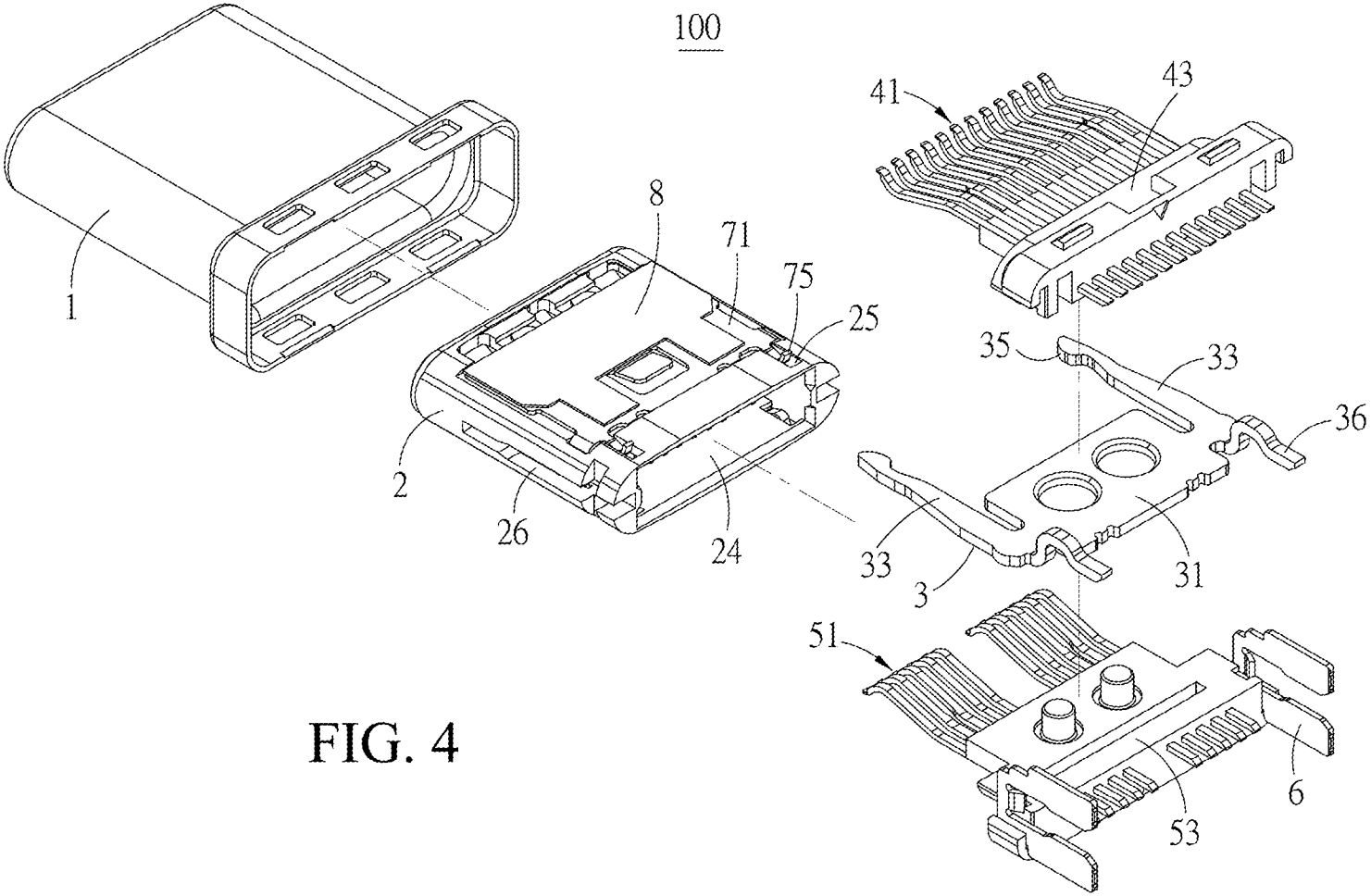
FIG. 4 illustrates an exploded view (2) of the electrical plug connector of the exemplary embodiment.
Figure 5:
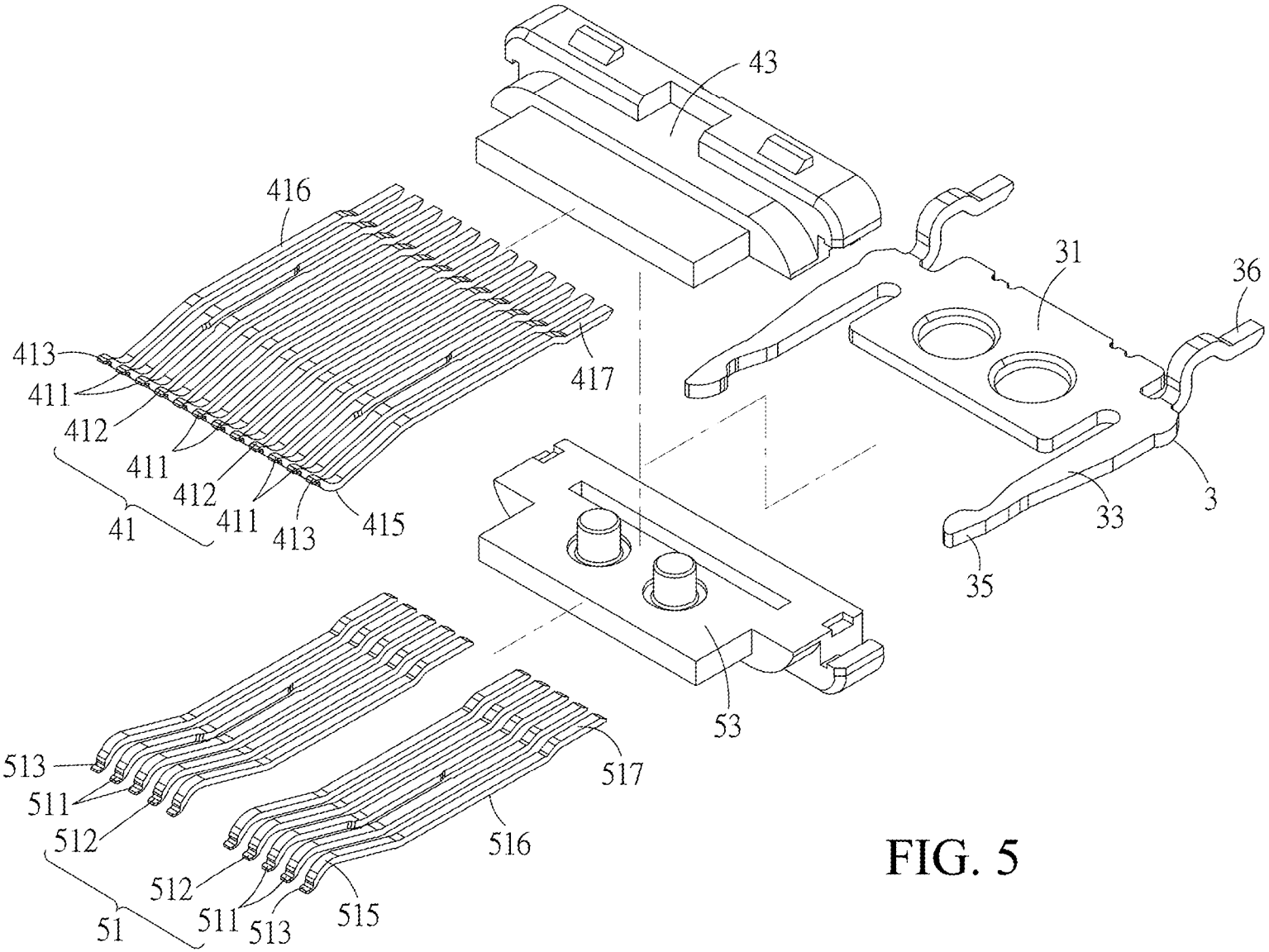
FIG. 5 illustrates an exploded view (3) of the electrical plug connector of the exemplary embodiment.

Please refer to FIGS. 2 to 5. An electrical plug connector 100 according to an exemplary embodiment of the instant disclosure is illustrated. FIG. 2 illustrates a perspective view of the electrical plug connector 100 of the exemplary embodiment. FIG. 3 illustrates an exploded view (1) of the electrical plug connector of the exemplary embodiment. FIG. 4 illustrates an exploded view (2) of the electrical plug connector 100 of the exemplary embodiment. FIGS. 3 and 4 illustrate exploded views of the electrical plug connector 100 from different perspectives. FIG. 5 illustrates an exploded view (3) of the electrical plug connector 100 of the exemplary embodiment; specifically, FIG. 5 illustrates an exploded view showing the first plug terminals 41, the second plug terminals 51, and the hook member 3 of the electrical plug connector 100 of the exemplary embodiment. In this embodiment, the electrical plug connector 100 can provide a reversible or dual orientation USB Type-C connector interface and pin assignments, i.e., a USB Type-C plug connector, but embodiments are not limited thereto. The electrical plug connector 100 comprises a metallic shell 1, an insulated housing 2, a hook member 3, a plurality of plug terminals (hereinafter, the plug terminals comprise first plug terminals 41 and second plug terminals 51 arranged into upper and lower rows, and pin assignments of the plug terminals are of the USB 3.0 signal transmission configuration, but embodiments are not limited thereto; in some embodiments, the plug terminals may be arranged into a single row, and pin assignments of the plug terminals are of the USB 2.0 signal transmission configuration). In the embodiments mentioned below, the hook member 3 is combined with the insulated housing 2 by assembling, but embodiments are not limited thereto. In some embodiments, the hook member 3 may be combined with the insulated housing 2 by insert-molding.

Please refer to FIGS. 2 and 3. In some embodiments, the metallic shell 1 is a hollowed shell formed by deep drawing techniques. In other words, the metallic shell 1 is a unitary element and is a seamless shell. The metallic shell 1 has a beautiful appearance and improved structural strength. In addition, the metallic shell 1 has a receiving cavity 11 therein. The metallic shell 1 encloses the insulated housing 2. In other words, the insulated housing 2 is received in the receiving cavity 11 along a longitudinal direction (i.e. rear-to-front direction or front-to-rear direction). In some embodiments, the metallic shell 1 is a unitary element.

Please refer to FIGS. 3 and 4. In some embodiments, one of two ends of the insulated housing 2 comprises an insertion cavity 22, and the other end of the insulated housing 2 comprises an assembling groove 24 communicating with the insertion cavity 22. Two sides of the insulated housing 2 comprise two recessed portions 26 respectively communicating with the insertion cavity 22.

Figure 6:
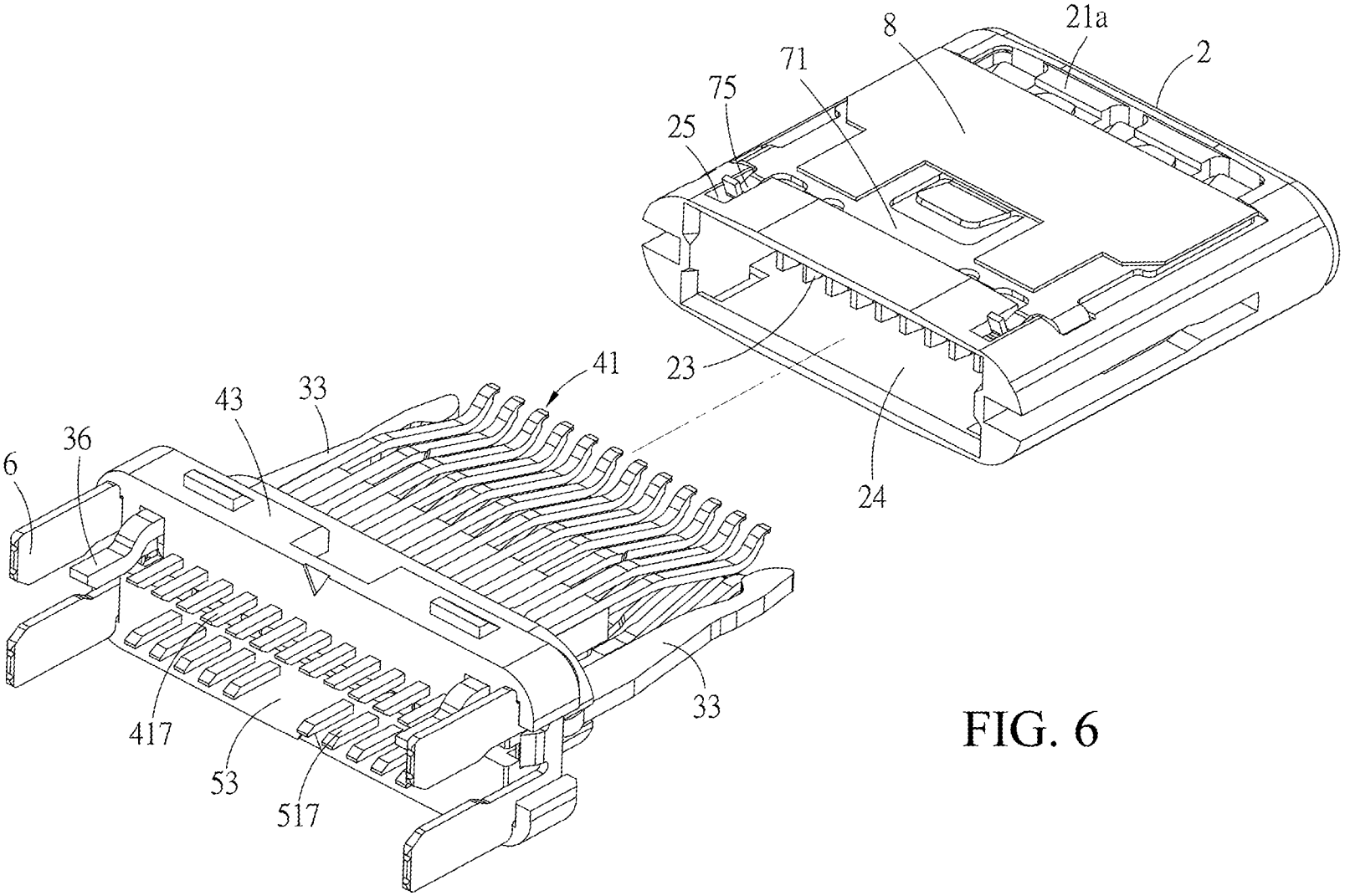
FIG. 6 illustrates a schematic exploded view showing that the electrical plug connector of the exemplary embodiment is to be assembled.
Figure 7:
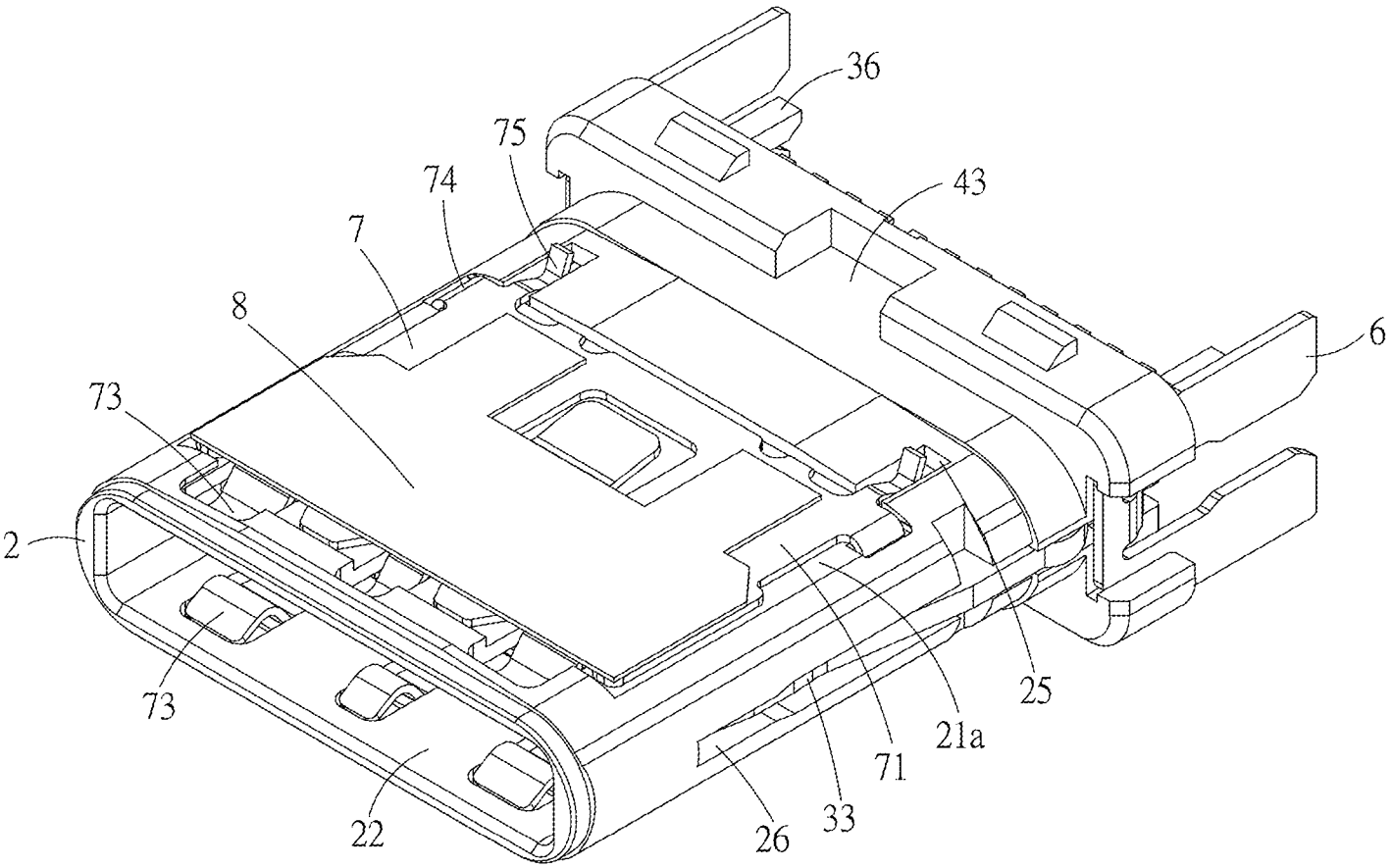
FIG. 7 illustrates a schematic perspective view showing that the electrical plug connector of the exemplary embodiment is assembled.
Figure 8:
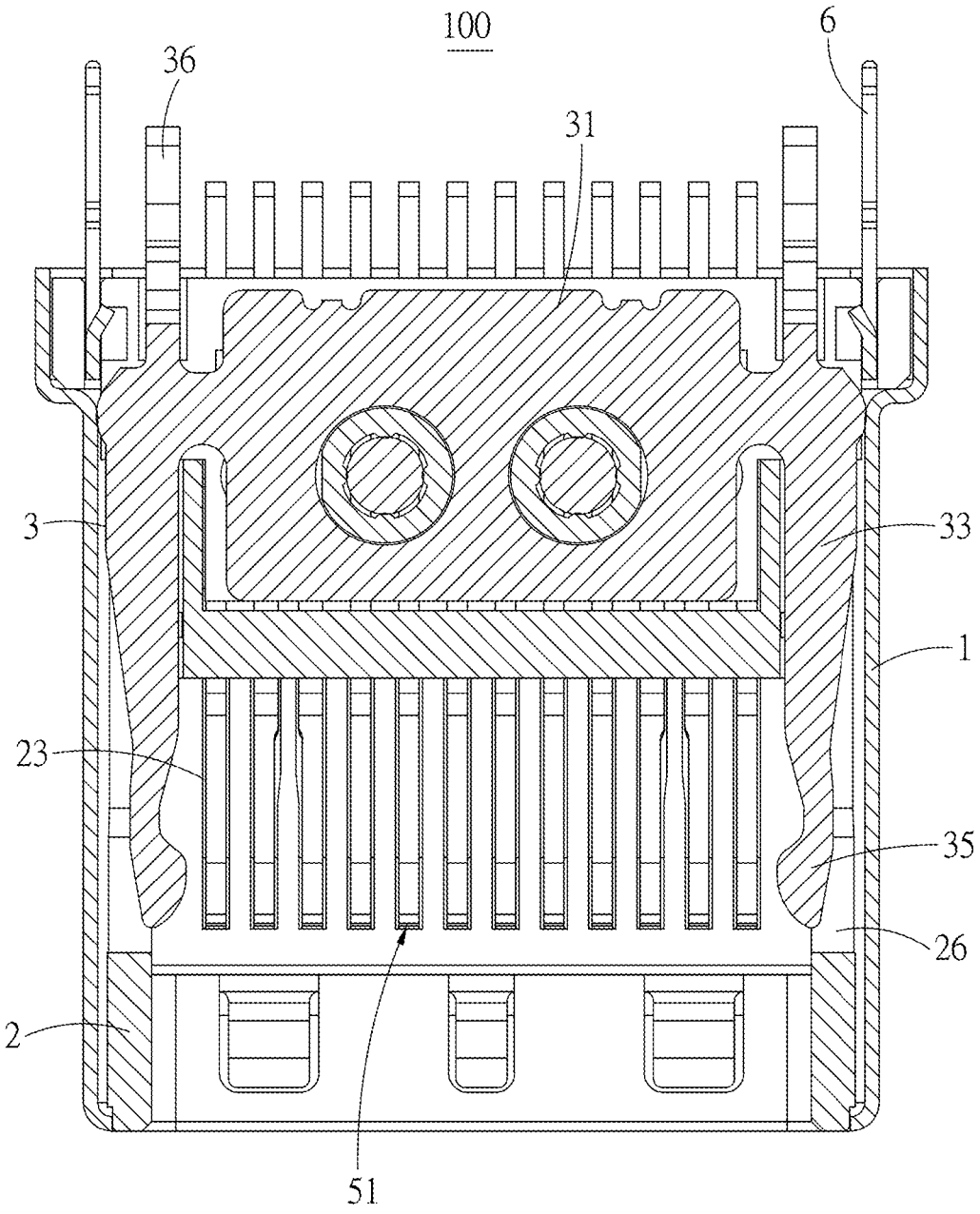
FIG. 8 illustrates a top sectional view showing that the electrical plug connector of the exemplary embodiment is assembled.
Figure 9:
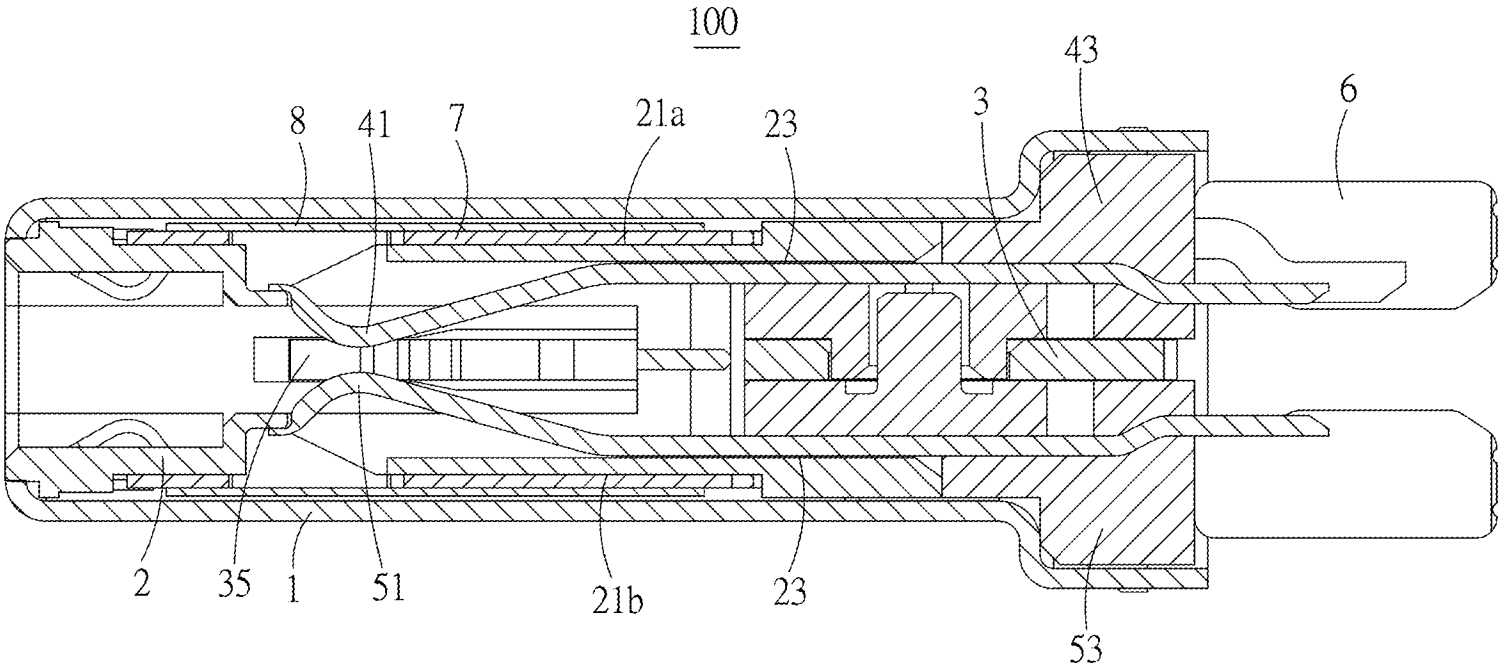
FIG. 9 illustrates a side sectional view showing that the electrical plug connector of the exemplary embodiment is assembled.

Please refer to FIGS. 3 to 9. FIG. 6 illustrates a schematic exploded view showing that the electrical plug connector 100 of the exemplary embodiment is to be assembled. FIG. 7 illustrates a schematic perspective view showing that the electrical plug connector 100 of the exemplary embodiment is assembled. FIG. 8 illustrates a top sectional view showing that the electrical plug connector 100 of the exemplary embodiment is assembled. FIG. 9 illustrates a side sectional view showing that the electrical plug connector 100 of the exemplary embodiment is assembled. In some embodiments, more specifically, the insulated housing 2 is a tubular elongated plate. In this embodiment, the insulated housing 2 is a tubular elongated plate. The upper portion of the insulated housing 2 is symmetrical to the lower portion of the insulated housing 2, and the left portion of the insulated housing 2 is symmetrical to the right portion of the insulated housing 2. The insulated housing 2 comprises a first assembling portion 21*a*, a second assembling portion 21*b*, an insertion cavity 22, a plurality of terminal grooves 23, and an assembling groove 24.

Please refer to FIGS. 3 and 9. In some embodiments, the insulated housing 2 comprises the first assembling portion 21*a* (which may be an upper portion or a lower portion of the insulated housing 2) and the second assembling portion 21*b* (which may be an upper portion or a lower portion of the insulated housing 2) corresponding to the first assembling portion 21*a*. The insertion cavity 22 is between the first assembling portion 21*a* and the second assembling portion 21*b*. The terminal grooves 23 are formed on the first assembling portion 21*a* and the second assembling portion 21*b* and in communication with the insertion cavity 22. Each of the terminal grooves 23 is an elongate groove. Each of the terminal grooves 23 is arranged on the first assembling portion 21*a* and the second assembling portion 21*b* along a length direction, and each of the terminal grooves 23 are defined through the first assembling portion 21*a* and the second assembling portion 21*b* and respectively in communication with the insertion cavity 22.

Please refer to FIGS. 3 to 9. In some embodiments, more specifically, the opening of the insertion cavity 22 is formed at the front end of the insulated housing 2 for mating with an electrical receptacle connector (not shown), and the assembling groove 24 is recessed inwardly from the rear end of the insulated housing 2. In other words, the rear portion of the insulated housing 2 has an assembling region for assembling with the first assembling block 43 and the second assembling block 53. The insertion cavity 22 is between the first assembling portion 21*a* and the second assembling portion 21*b*.

Please refer to FIGS. 3, 5, and 9. In some embodiments, the plug terminals are held in the insertion cavity 22 and the assembling groove 24. The plug terminals comprise a plurality of first plug terminals 41, and one end of each of the first plug terminals 41 extends into the insertion cavity 22.

Please refer to FIGS. 3 to 9. In some embodiments, more specifically, the electrical plug connector 100 comprises a first assembling block 43 molded with the first plug terminals 41. Each of first plug terminals 41 extends from the insertion cavity 22 toward the corresponding terminal groove 23 of the first assembling portion 21*a*, and the first assembling block 43 is formed with the first body portion 416 of each of the first plug terminals 41.

Please refer to FIGS. 3 to 9. In some embodiments, the plug terminals comprises a plurality of second plug terminals 51, and one end of each of the second plug terminals 51 extends into the insertion cavity 22.

Please refer to FIGS. 3 to 9. In some embodiments, more specifically, the electrical plug connector 100 comprises a second assembling block 53 molded with the second plug terminals 51. The second assembling block 53 is molded with the first assembling block 43. Each of second plug terminals 51 extends from the insertion cavity 22 toward the corresponding terminal groove 23 of the second assembling portion 21*b*, and the second assembling block 53 is formed with the second body portion 516 of each of the second plug terminals 51.

Please refer to FIGS. 3 to 9. In some embodiments, the first plug terminals 41 comprise a plurality of signal terminals 411, at least one power terminal 412, and at least one ground terminal 413. The first plug terminals 41 are held in the insulated housing 2. From a front view of the first plug terminals 41, the first plug terminals 41 comprise, from right to left, a ground terminal 413 (Gnd), a first pair of high-speed signal terminals (TX1+−, differential signal terminals), a power terminal 412 (Power/VBUS), a first function detection terminal (CC1, a terminal for inserting orientation detection of the connector and for cable recognition), a pair of low-speed signal terminals (D+−, differential signal terminals), a first reserved terminal (RFU), another power terminal 412 (Power/VBUS), a second pair of high-speed signal terminals (RX2+−, differential signal terminals), and another ground terminal 413 (Gnd).

Please refer to FIGS. 3 to 9. In some embodiments, each of the first plug terminals 41 comprises a first flexible contact portion 415, a first body portion 416, and a first tail portion 417. In this embodiment, the first body portions 416 are held in the first assembling block 43. The first flexible contact portion 415 extends forward from the first body portion 416 in the rear-to-front direction and held in the terminal groove 23 of the first assembling portion 21*a*, and the first tail portion 417 extends backward from the first body portion 416 in the front-to-rear direction and protrudes out of the first assembling block 43. The first flexible contact portion 415 has a curved profile. The first signal terminals 411 are provided for transmitting first signals (i.e., USB 3.0 signals).

Please refer to FIGS. 3 to 9. In some embodiments, the second plug terminals 51 comprise a plurality of signal terminals 511, at least one power terminal 512, and at least one ground terminal 513. The second plug terminals 51 are held in the insulated housing 2. From a front view of the second plug terminals 51, the second plug terminals 51 comprise, from left to right, a ground terminal 513 (Gnd), a first pair of high-speed signal terminals (TX2+−, differential signal terminals), a power terminal 512 (Power/VBUS), a second function detection terminal (CC2, a terminal for inserting orientation detection of the connector and for cable recognition), a pair of low-speed signal terminals (D+−, differential signal terminals), a second reserved terminal (RFU), another power terminal 512 (Power/VBUS), a second pair of high-speed signal terminals (RX1+−, differential signal terminals), and another ground terminal 513 (Gnd).

Please refer to FIGS. 3 to 9. In some embodiments, each of the second plug terminals 51 comprises a second flexible contact portion 515, a second body portion 516, and a second tail portion 517. The second body portions 516 are held in the second assembling block 53. The second flexible contact portion 515 extends forward from the second body portion 516 in the rear-to-front direction and held in the terminal groove 23 of the second assembling portion 21*b*.

Please refer to FIGS. 3 to 9. In some embodiments, the second tail portion 517 extends backward from the second body portion 516 in the front-to-rear direction and protrudes out of the second assembling block 53. The second flexible contact portion 515 has a curved profile, and the second flexible contact portions 515 correspond to the first flexible contact portions 415. In other words, for example, the first flexible contact portion 415 may be curved inward but the corresponding second flexible contact portion 515 may be curved outward. Each of the first tail portions 417 and the corresponding second tail portion 517 form a clamp for holding and contacting a circuit board. Moreover, the second signal terminals 511 are provided for transmitting second signals (i.e., USB 3.0 signals).

Please refer to FIGS. 3 to 9. In some embodiments, the electrical plug connector 100 further comprises a plurality of stopping sheets 8 (Mylar sheets). Each of the stopping sheets 8 is between the corresponding abutting sheet 7 and the metallic shell 1. Therefore, the stopping sheets 8 shields the first flexible contact portions 415 and the second flexible contact portions 515, so that the stopping sheets 8 can prevent the first flexible contact portions 415 and the second flexible contact portions 515 from being in contact with the metallic shell 1.

Please refer to FIGS. 3 to 9. In some embodiments, the hook member 3 comprises a plurality of side arms 33 and a plurality of hook portions 35. The side arms 33 extend in the Z axis direction, as indicated in FIG. 3. The side arms 33 are disposed at the recessed portions 26 at two sides of the insulated housing 2. Each of the hook portions 35 is at an end portion of the corresponding side arm 33 and extends into the insertion cavity 22. An inner side of each of the hook portions 35 forms a first positioning portion 351 and a second positioning portion 352. The first positioning portion 351 is adjacent to an end portion of the hook portion 35 and is an outer side of the hook member 3, and the second positioning portion 352 is away from the end portion of the hook portion 35 and is at an inner side of the hook member 3.

Please refer to FIGS. 3 to 9. In some embodiments, each of the hook portions 35 is formed at the front end of the corresponding side arm 33, and the hook portions 35 are provided for contacting an electrical receptacle connector. When the electrical plug connector 100 is mated with an electrical receptacle connector, the hook portions 35 provide a holding force for positioning with the protrusions 95 at two sides of the tongue portion of the electrical receptacle connector (as shown in FIG. 11).

Figure 10:
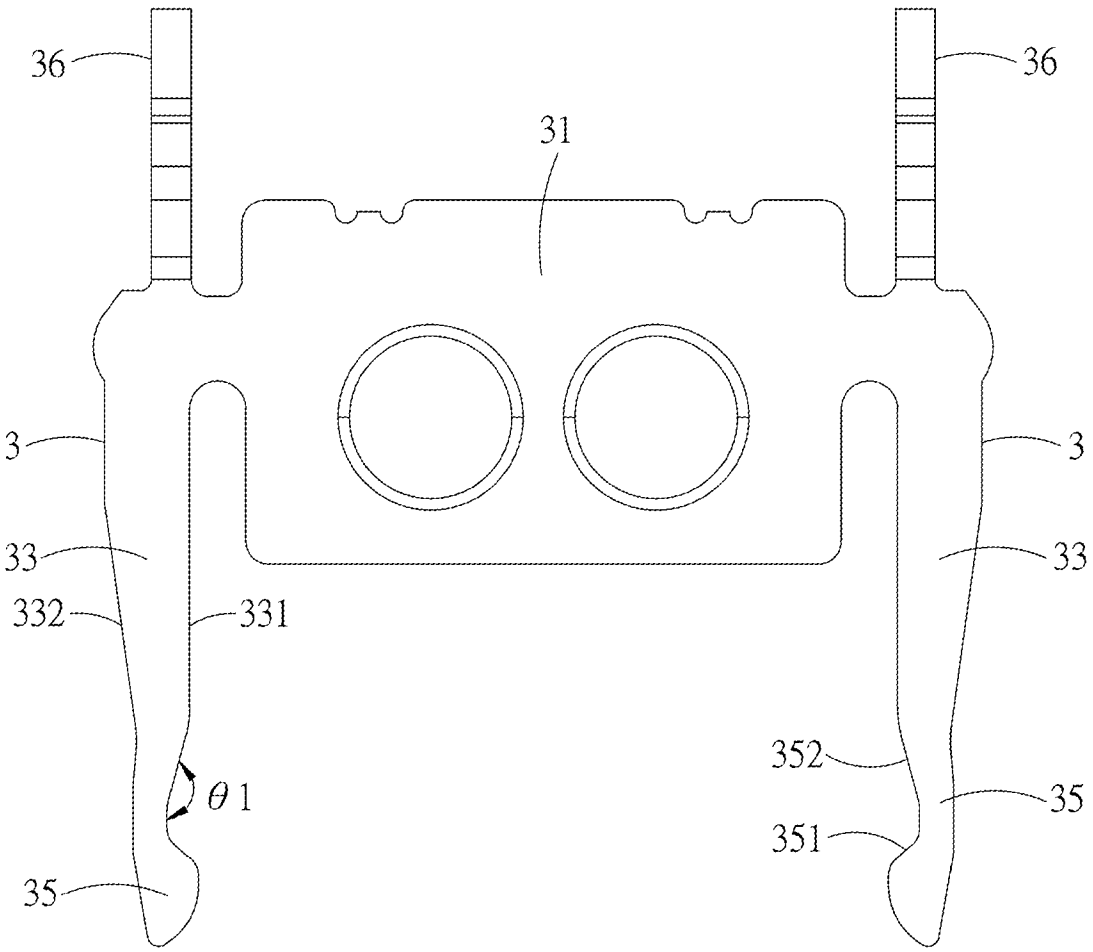
FIG. 10 illustrates a top view of the hook member of the electrical plug connector of the exemplary embodiment.
Figure 11:
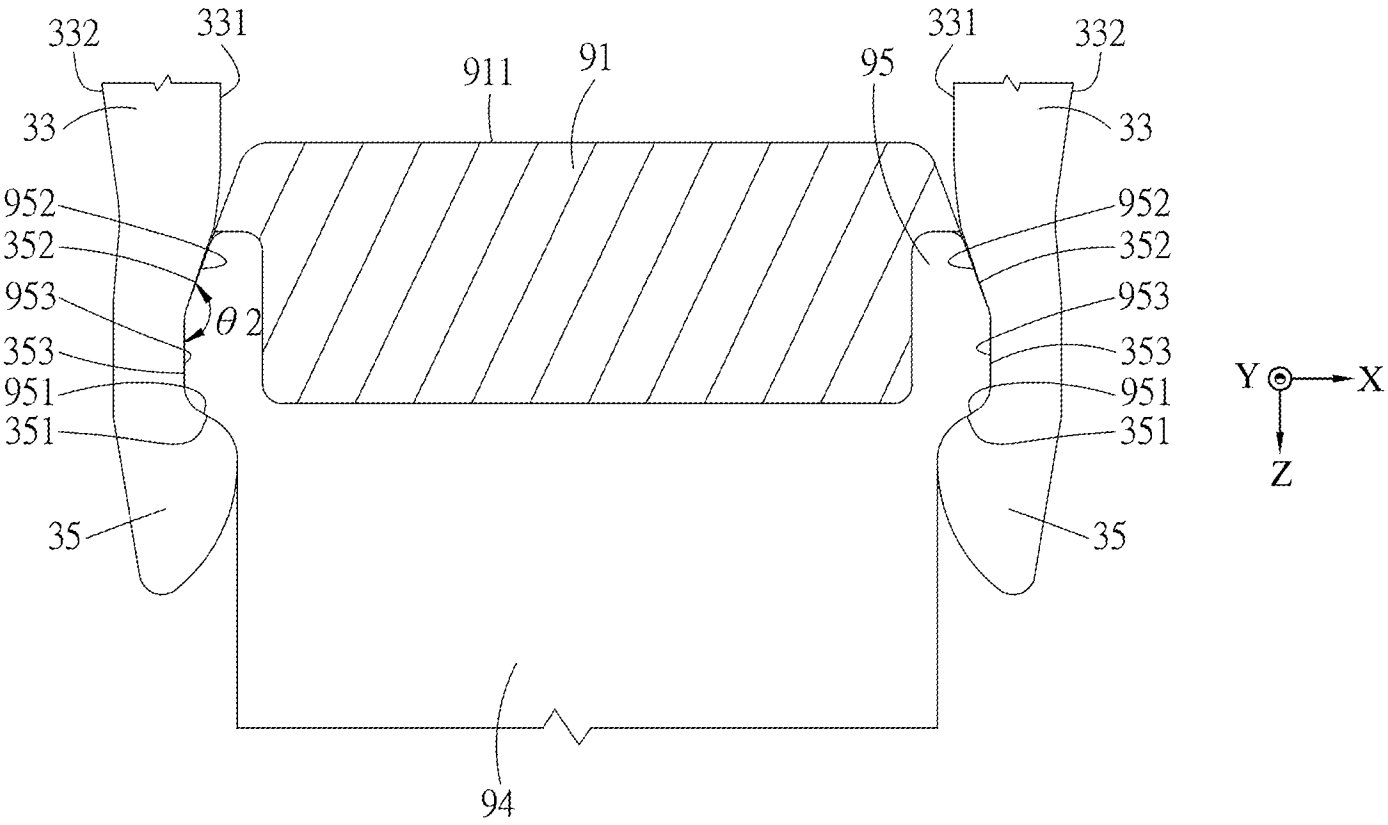
FIG. 11 illustrates a partial top view of the hook member of the electrical plug connector of the exemplary embodiment and protrusions of an electrical receptacle connector.

Please refer to FIGS. 3 to 11. FIG. 10 illustrates a top view of the hook member 3 of the electrical plug connector 100 of the exemplary embodiment. FIG. 11 illustrates a partial top view of the hook member 3 of the electrical plug connector 100 of the exemplary embodiment and the protrusions 95 of an electrical receptacle connector. In some embodiments, the electrical plug connector 100 is provided for being mated with an electrical receptacle connector, and two protrusions 95 are at two sides of a tongue portion 91 of the electrical receptacle connector. Each of the protrusions 95 has a first side surface 951, a second side surface 952, and a third side surface 953. In some embodiments, the second side surfaces 952 are at two sides of an end portion 911 of the tongue portion 91 (as shown in FIG. 11), the two third side surfaces 953 outward extend from side portions of the two second side surfaces 952, respectively, and the two first side surfaces 951 extend toward a middle portion of the tongue portion 91 from side portions of the two third side surfaces 953, respectively. In some embodiments, the protrusion 95 protrudes out of the side portion of the tongue portion 91 and is approximately formed as a trapezoid structure, and the two inclined surfaces of the trapezoid structure are respectively the first side surface 951 and the second side surface 952. An angle θ2 is between the second side surface 952 and the third side surface 953 (as shown in FIG. 11). The angle θ2 is in a range between 110 degrees and 160 degrees; for example, the angle θ2 may be 120 degrees, 140 degrees, or 150 degrees.

Please refer to FIGS. 3 to 11. In some embodiments, when the electrical plug connector 100 is to be detached from the electrical receptacle connector, the first positioning portions 351 buckle with the first side surfaces 951 of the protrusions 95 at two sides of the tongue portion 91 of the electrical receptacle connector, so that the degree of freedom for the upward movement of the side arms 33 in the Z axis direction shown in FIG. 11 is limited. Please refer to FIGS. 3 to 11. In some embodiments, when the electrical plug connector 100 is to be mated with the electrical receptacle connector, the second positioning portions 352 abut on the second side surfaces 952 of the protrusions 95 at two sides of the tongue portion 91 of the electrical receptacle connector, so that the number of the contact portions between the electrical plug connector 100 and the electrical receptacle connector increases, thereby improving the holding and the positioning function between the electrical plug connector 100 and the electrical receptacle connector. Accordingly, possibility of that the electrical plug connector 100 shakes in the electrical receptacle connector can be reduced. Hence, the degree of freedom for the downward movement of the side arms 33 in the Z axis direction shown in FIG. 11 is limited, thereby preventing the electrical plug connector 100 from getting loosen in the Z axis direction.

As shown in FIGS. 10 and 11, the first positioning portions 351 and the second positioning portions 352 of the two hook portions 35 are respectively in contact with the first side surfaces 951 and the second side surfaces 952 of the protrusions 95 at the two sides of the tongue portion 91. Hence, upper portions and lower portions of the protrusions 95 at the left side and the right side of the tongue portion 91 have four contact portions, so that the degree of freedom for the movements of the side arms 33 in the X axis direction and the Z axis direction shown in FIG. 11 are limited, thereby allowing the electrical plug connector 100 to be properly positioned in the electrical receptacle connector when the electrical plug connector 100 is mated with the electrical receptacle connector.

Please refer to FIGS. 3 to 9. In some embodiments, the hook member 3 is formed by blanking techniques, but embodiments are not limited thereto. In some embodiments, the hook member 3 may be formed by stamping techniques. A hook member 3 formed by blanking has a better structural strength than a hook member 3 formed by stamping.

Please refer to FIGS. 3 to 9. In some embodiments, the hook member 3 comprises a lateral arm 31. The lateral arm 31 is between the side arms 33 and is integrally formed with the side arms 33. The lateral arm 31 is approximately of a rectangular plate held in the assembling groove 24. The lateral arm 31 and the side arms 33 together form an upside-down U shape structure.

Please refer to FIGS. 3 to 11. In some embodiments, an inner side of each of the side arms 33 comprises a straight surface 331 extending linearly. The straight surface 331 extends along the Z axis direction shown in FIG. 11. Moreover, an outer side of each of the side arms 33 comprises an inclined surface 332 extending obliquely. Moreover, the side arms 33 are symmetrical with each other.

The side arms 33 extend outward from two sides of the lateral arm 31 in a same direction, respectively, and front ends of the side arms 33 are inserted into the insertion cavity 22 from the recessed portions 26 at the two sides of the insulated housing 2.

Please refer to FIGS. 3 to 9. In some embodiments, each of the hook portions 35 comprises a third positioning portion 353 between the first positioning portion 351 and the second positioning portion 352 (as shown in FIG. 11). The first positioning portion 351, the second positioning portion 352, and the third positioning portion 353 are formed as a geometrical recessed structure, approximately a trapezoid structure. The geometrical shape formed by the first positioning portion 351, the second positioning portion 352, and the third positioning portion 353 corresponds to the geometrical shape of the protrusion 95 at the side of the tongue portion 91 of the electrical receptacle connector. The third positioning portion 353 extends in the Z axis direction shown in FIG. 11. In some embodiments, an angle θ1 is between the second positioning portion 352 and the third positioning portion 353 (as shown in FIG. 10). The angle θ1 is in a range between 110 degrees and 160 degrees; for example, the angle θ1 may be 120 degrees, 140 degrees, or 150 degrees.

Please refer to FIGS. 3 to 11. In some embodiments, each of the protrusions 95 at the side portion of the tongue portion 91 of the electrical receptacle connector comprises a third side surface 953 for contacting the third positioning portion 353. In this embodiment, the first side surface 951, the second side surface 952, and the third side surface 953 are approximately formed as a trapezoid structure.

Please refer to FIGS. 3 to 9. In some embodiments, the hook member comprises a plurality of legs. Each of the legs 36 outward extends, from a rear portion of the corresponding side arm 33, out of the insulated housing 2. The legs 36 extend out of the insulated housing 2 to be in contact with a circuit board.

Please refer to FIGS. 3 to 9. In some embodiments, the electrical plug connector 100 further comprises a plurality of abutting sheets 7. The abutting sheets 7 are respectively on the upper surface and the lower surface of the insulated housing 2. Specifically, in some embodiments, the abutting sheets 7 are respectively on the first assembling portion 21*a* and the second assembling portion 21*b*. Each of the abutting sheets 7 comprises a main body 71 and a plurality of elastic arms 75 outwardly extending from a rear portion of the main body 71. Each of the elastic arms 75 extends toward the corresponding recessed hole 25 of the insulated housing 2, and each of the elastic arms 75 is in contact with the at least one ground terminal 413 of the first plug terminals 41 and the inner surface of the metallic shell 1.

Please refer to FIGS. 3 to 9. In some embodiments, the electrical plug connector 100 further comprises a plurality of clamping sheets 6 combined with two sides of the first assembling block 43 and two sides of the second assembling block 53. The clamping sheets 6 can be provided for holding the side portions of the circuit board, thereby allowing the electrical plug connector 100 to be positioned with the circuit board properly.

According to one or some embodiments of the instant disclosure, the hook portion of the hook member forms the first positioning portion and the second positioning portion. The first positioning portions are provided for buckling with the first side surfaces of the protrusions on the two sides of the tongue portion of the electrical receptacle connector, and the second positioning portions are provided for buckling with the second surface side surfaces of the protrusions on the two sides of the tongue portion of the electrical receptacle connector. Accordingly, the electrical plug connector can be positioned with the electrical receptacle connector through multiple contacts, thereby preventing the electrical plug connector from shaking when the electrical plug connector is mated with the electrical receptacle connector.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, suitable for being mated with an electrical receptacle connector, wherein two protrusions are at two sides of a tongue portion of the electrical receptacle connector, and each of the protrusions has a first side surface, a second side surface, and a third surface, wherein the second side surfaces are at two sides of an end portion of the tongue portion, the two third side surfaces outwardly extend from side portions of the two second side surfaces, respectively, and the two first side surfaces extend toward a middle portion of the tongue portion from side portions of the two third side surfaces, respectively, wherein the electrical plug connector comprises:

a metallic shell comprising a receiving cavity;

an insulated housing received in the metallic shell, wherein one of two ends of the insulated housing comprises an insertion cavity;

a plurality of plug terminals held in the insulated housing, wherein one end of each of the plug terminals extends into the insertion cavity; and a hook member comprising a plurality of side arms and a plurality of hook portions, wherein the side arms are respectively at two sides of the insulated housing, each of the hook portions is at an end portion of the corresponding side arm and extends into the insertion cavity; an inner side of each of the hook portions forms a first positioning portion and a second positioning portion, the first positioning portion is adjacent to an end portion of the hook portion and is at an outer side of the hook member, and the second positioning portion is away from the end portion of the hook portion and is at an inner side of the hook member; each of the first positioning portions is provided for being in contact with the first side surface of the corresponding protrusion, and each of the second positioning portions is provided for being in contact with the second side surface of the corresponding protrusion, wherein each of the hook portions comprises a third positioning portion between the first positioning portion and the second positioning portion, the first positioning portion, the second positioning portion, and the third positioning portion are formed as a geometrical recessed structure, and the third positioning portion is provided for being in contact with the third side surface, an angle is between the second positioning portion and the third positioning portion, and the angle is in a range between 110 degrees and 160 degrees, an inner side of each of the side arms comprises a straight surface extending linearly, and an outer side of each of the side arms comprises an inclined surface extending obliquely.

2. The electrical plug connector according to claim 1, wherein the other end of the insulated housing comprises an assembling groove communicating with the insertion cavity, the two sides of the insulated housing comprise two recessed portions respectively communicating with the insertion cavity.

3. The electrical plug connector according to claim 1, wherein the other end of the insulated housing comprises an assembling groove communicating with the insertion cavity, the two sides of the insulated housing comprise two recessed portions respectively communicating with the insertion cavity.

4. The electrical plug connector according to claim 1, wherein the other end of the insulated housing comprises an assembling groove communicating with the insertion cavity, the two sides of the insulated housing comprise two recessed portions respectively communicating with the insertion cavity.

5. The electrical plug connector according to claim 1, wherein the plug terminals comprise a plurality of first plug terminals and a plurality of second plug terminals, wherein the electrical plug connector further comprises a first assembling block and a second assembling block, the first assembling block is molded with the first plug terminals, and the second assembling block is molded with the second plug terminals.

6. The electrical plug connector according to claim 5, wherein the first plug terminals comprise a plurality of first signal terminals, at least one first power terminal, and at least one first ground terminal, and wherein the second plug terminals comprise a plurality of second signal terminals, at least one second power terminal, and at least one second ground terminal.

7. The electrical plug connector according to claim 1, wherein the plug terminals comprise a plurality of first plug terminals and a plurality of second plug terminals, wherein the electrical plug connector further comprises a first assembling block and a second assembling block, the first assembling block is molded with the first plug terminals, and the second assembling block is molded with the second plug terminals.

8. The electrical plug connector according to claim 7, wherein the first plug terminals comprise a plurality of first signal terminals, at least one first power terminal, and at least one first ground terminal, and wherein the second plug terminals comprise a plurality of second signal terminals, at least one second power terminal, and at least one second ground terminal.

9. The electrical plug connector according to claim 1, wherein the plug terminals comprise a plurality of first plug terminals and a plurality of second plug terminals, wherein the electrical plug connector further comprises a first assembling block and a second assembling block, the first assembling block is molded with the first plug terminals, and the second assembling block is molded with the second plug terminals.

10. The electrical plug connector according to claim 9, wherein the first plug terminals comprise a plurality of first signal terminals, at least one first power terminal, and at least one first ground terminal, and wherein the second plug terminals comprise a plurality of second signal terminals, at least one second power terminal, and at least one second ground terminal.

11. The electrical plug connector according to claim 1, further comprising a plurality of abutting sheets respectively at an upper surface and a lower surface of the insulated housing.

12. The electrical plug connector according to claim 11, further comprising a plurality of stopping sheets, wherein each of the stopping sheets is between the corresponding abutting sheet and the metallic shell.

13. The electrical plug connector according to claim 1, further comprising a plurality of abutting sheets respectively at an upper surface and a lower surface of the insulated housing.

14. The electrical plug connector according to claim 13, further comprising a plurality of stopping sheets, each of the stopping sheets is between the corresponding abutting sheet and the metallic shell.

15. The electrical plug connector according to claim 1, further comprising a plurality of abutting sheets respectively at an upper surface and a lower surface of the insulated housing.

16. The electrical plug connector according to claim 15, further comprising a plurality of stopping sheets, each of the stopping sheets is between the corresponding abutting sheet and the metallic shell.

* * * * *